United States Patent [19]

Treadway

[11] Patent Number: 4,976,442

[45] Date of Patent: Dec. 11, 1990

[54] ARROW WITH REMOVABLE TRANSMITTER AND METHOD OF USE

[76] Inventor: Woodrow L. Treadway, 505 W. Main, Jonesboro, La. 71251

[21] Appl. No.: 297,615

[22] Filed: Jan. 17, 1989

[51] Int. Cl.[5] ..... F41B 6/04

[52] U.S. Cl. ..... 273/416

[58] Field of Search ..... 273/416, 418–423; 455/96, 98, 100, 66; 604/59–64; 43/6

[56] References Cited

U.S. PATENT DOCUMENTS

| | | | |
|---|---|---|---|
| 3,790,948 | 2/1974 | Ratkovich | 273/416 X |
| 4,651,999 | 3/1987 | Sturm | 273/416 |
| 4,858,935 | 8/1989 | Capson | 273/416 |

*Primary Examiner*—Paul E. Shapiro

*Attorney, Agent, or Firm*—John M. Harrison

[57] ABSTRACT

An arrow having a removable, battery-operated transmitter with an antenna, which transmitter is adapted to fit in a notch or slot provided in the arrow shaft, the transmitter further provided with a curved hook which terminates in a sharp hook tip having a barb. The hook tip and barb are designed to project through the slot or notch in the arrow shaft and engage and remain in the hide, bone or tissue of a deer or other game animal when the arrow strikes the animal, wherein the force of the strike causes the transmitter to exit the notch in the arrow shaft and remain in the animal, regardless of the arrow location. Accordingly, after the arrow strikes and penetrates the animal, whether the arrow breaks or travels completely through the animal, the transmitter remains in the animal and emits a radio signal capable of being received by a portable radio receiver, in order to track the game animal if a clean kill is not made. Alternatively, if the arrow misses the intended target, it may be easily located by the radio signal. A method of tracking a game animal by radio during archery hunting, which includes the steps of providing a notch or slot in the arrow shaft; inserting a battery-operated, hook-equipped radio transmiter in the notch or slot; impacting the arrow with the game animal to embed the hook in the game animal and remove the transmitter from the arrow shaft; and using a radio receiver which is tuned to the radio frequency of the transmitter for tracking the game animal.

13 Claims, 1 Drawing Sheet

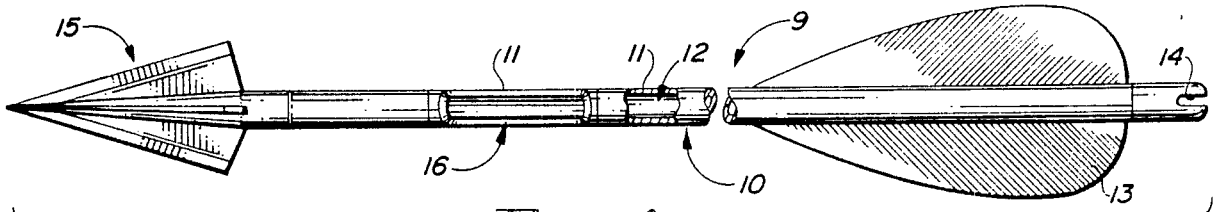
FIG. 1
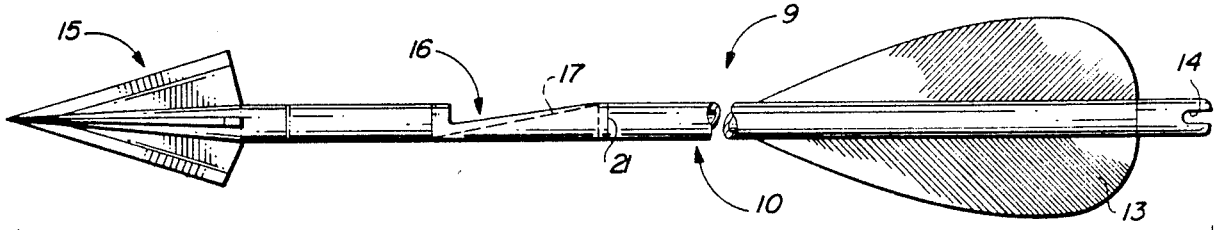
FIG. 2
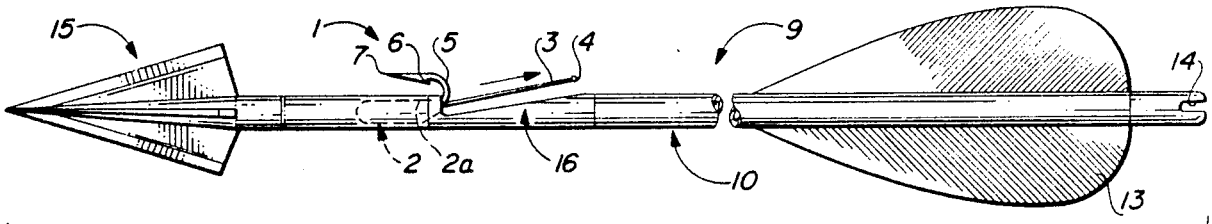
FIG. 3
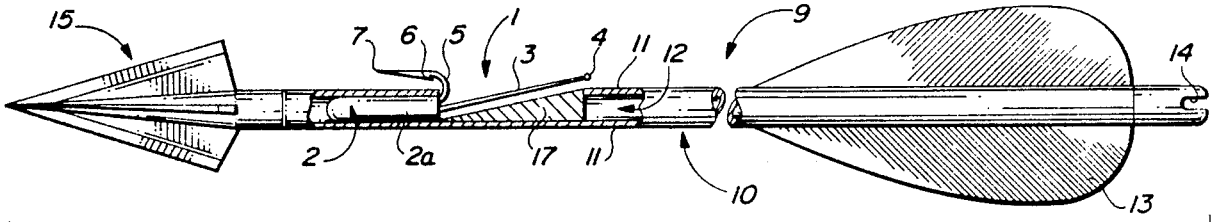
FIG. 4
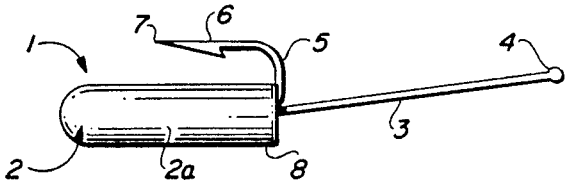
FIG. 5
FIG. 7
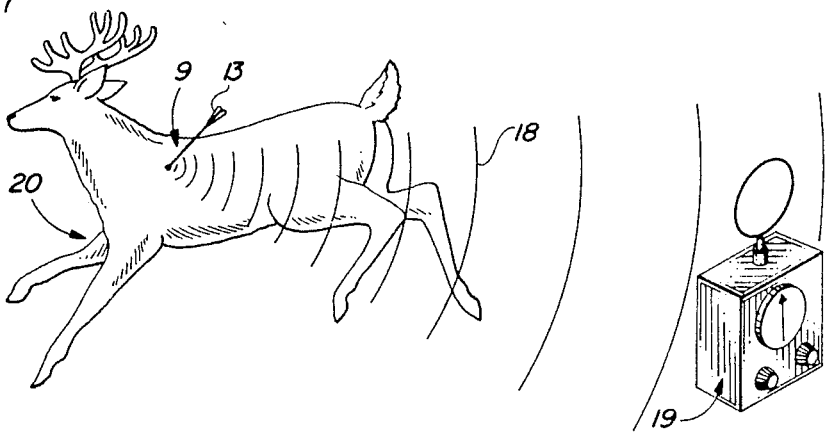
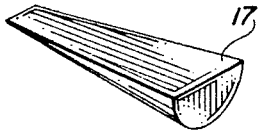
FIG. 6

ARROW WITH REMOVABLE TRANSMITTER AND METHOD OF USE

BACKGROUND OF THE INVENTION

1. Field of the Invention

This invention relates to bow hunting for game animals such as deer, elk, bear and the like and more particularly, to an arrow-mounted, battery-powered radio transmitter and method of using the transmitter. The transmitter is characterized by a transmitter housing that encases or encapsulates appropriate electronic transmitter components powered by a small battery, an antenna extending from one end of the housing and a curved hook shank, one end of which is mounted in the housing and the other end tapering to define a sharp tip and a barb. The transmitter is designed for insertion in a notch, slot or a hollow cavity or bore provided in an arrow shaft, with the antenna, hook barb and tip protruding from the notch. When the arrow strikes a deer, elk or other game animal, the forwardly-extending hook tip and barb engage the hide, bone or tissue of the animal as the arrow enters, and this action removes the transmitter from the notch or slot in the arrow shaft. Accordingly, whether the arrow flies completely through the game animal or remains embedded and breaks, or ultimately pulls out of the animal, the transmitter is independently secured to the game animal by operation of the hook and barb and is adapted to transmit a radio signal to a compatible portable radio receiver held by the hunter for tracking purposes, in the event that a clean kill is not effected.

One of the problems which exists in the hunting of deer, elk, bear and other game animals with a bow and arrow is that of tracking the animals when the hunter fails to make a clean kill. Since arrows do not effect the heavy impact of bullets and only one opportunity is usually afforded with a single arrow for making a kill, many game animals are wounded rather than immediately killed by the arrow and must be tracked by the hunter. Tracking deer, elk, bear or other game animals which are wounded by an arrow is sometimes difficult, and may be dangerous, particularly in dense brush and woodland, since the wound sometimes closes, leaving a minimal blood trail or no blood trail at all and the animal frequently escapes, only to die later or lie in wait for the hunter.

DESCRIPTION OF THE PRIOR ART

Several devices have been developed for tracking and locating game animals which have been wounded by hunters. In U.S. Pat. No. 3,150,875 a chemical detection technique is disclosed, wherein two chemicals are contained in the shaft of an arrow in separate vials. Upon impact with a game animal or the ground, the vials break and intermixing of the two chemicals produces visible smoke. By following the trail of smoke, the hunter may track the animal or retrieve the arrow. In thickly wooded areas, however, the smoke may be visible for only a very short distance and if there is any wind, the smoke trail is quickly disbursed. In U.S. Pat. No. 3,417,944, a hunting arrow is disclosed which includes a continuous line of marking yarn connecting the bow to the arrow, which yarn, upon shooting of an arrow, creates a trail marking the path of the wounded animal. However, the yarn may become entangled in trees or brush, and broken by the fleeing animal. Moreover, under circumstances where the animal is only slightly wounded and runs a long distance, there may not be enough yarn in the arrow to provide an adequate trail. Furthermore, when the arrow is shot, the trailing yarn adversely affects the arrow trajectory and accuracy. In U.S. Pat. No. 4,421,319, an arrow is disclosed which includes a device located in the arrow nock that produces an audible signal. However, because the trailing end of the arrow is frequently broken off as the animal runs through the woods, the nock-containing device for producing the desired signal frequently does not remain with the wounded animal. Furthermore, under circumstances where the arrow is not broken off, the audible signal may frighten the wounded animal so that it continues to run in an effort to escape the sound. This could result in the animal moving out of the range of hearing of the hunter, thereby again lessening, rather than increasing, the possibility of recovering the game.

Many devices have also been developed in the art for radio communication during hunting. U.S. Pat. No. 3,336,530, dated Aug. 15, 1967, to R. J. Sloan, et al, details a "Direction Finding System For Hunting Dogs". The direction finding system detailed in this patent includes a collar having a radio receiver and antenna attached thereto and the hunter carries a properly tuned radio transmitter, in order to direct the dog's actions at a distance. U.S. Pat. No. 3,790,948, dated Feb. 5, 1974, to John M. Ratkovich, details a "Radio Transmitting Hunting Arrow With Finding Means", which transmitter is carried in the tip of a hunting arrow to aid in locating wounded game. The antenna for the transmitter is placed in the hollow shank of the arrow, so that breakage of the shaft will not be detrimental to transmission of radio signals from the transmitter. However, if the arrow flies completely through the animal, the device is ineffective for its intended purpose. A "Spent Hunting Arrow Locating Means" is detailed in U.S. Pat. No. 4,675,683 dated June 23, 1987, to Charles R. Robinson. The patent discloses a battery-powered radio transmitter having a diameter which is substantially equal to the diameter of an arrow shaft, and the transmitter is positioned in series between the head and nock of a metallic hunting arrow. The transmitter section of the shaft is light in weight, so as not to adversely affect the normal flight characteristics of the arrow and the shaft portion located between the transmitter and the nock, acts as an antenna for the transmitter. A switch is provided for operation of the transmitter and a portable directional radio receiver having the same frequency as the transmitter, is utilized by the hunter to track the spent arrow. The device will not operate to track a game animal if the arrow flies completely through the animal of if that portion of the arrow shaft which contains the transmitter is broken off as the animal runs away from the hunter. U.S. Pat. No. 4,704,612, dated November 3, 1987, to Dan D. Boy, details a 'System for Recovering a Hunting Arrow'. The patent outlines a method and apparatus for tracking an arrow and/or a game animal that has been shot while archery hunting, which arrow contains a radio-frequency transmitter in a circuit also containing a power supply, with an inertia-activated switch in the shaft thereof. The circuit is of a size and weight so as not to alter desirable flight characteristics of the arrow and once the arrow is shot, the inertia-activation switch momentarily closes, causing the transmitter to transmit a signal. The archer carries a radio frequency receiver having a directional antenna and a magnitude indicator and ear phone coupled thereto, to facilitate tracking and retrieval of the arrow and the game animal. The Boy device suffers from the same deficiencies as the Robinson patent, regarding flight of the arrow through the game animal or breaking the shaft at a critical point.

It is an object of this invention to provide a new and improved arrow-mounted transmitter which is located in a notch or slot in an arrow shaft and is designed to engage and lodge in a game animal and exit the arrow shaft via the notch or slot when the arrow strikes the animal, to provide a positive radio signal which is independent of the arrow, for tracking by the hunter using a properly tuned radio receiver.

Another object of the invention is to provide an arrow mounted, battery-operated radio transmitter which is designed to fit in the hollow cavity of an arrow shaft and is fitted with a hook projecting externally of the arrow shaft, for engaging the hide, bone or tissue of a game animal when the arrow strikes the animal and causing the transmitter to exit the arrow shaft, remain in the animal and provide a means for emitting radio signals which are received by a radio receiver operated by a hunter, for tracking the wounded animal.

Yet another object of the invention is to provide an arrow which is adapted to contain a battery-operated radio transmitter characterized by a small cylindrical transmitter housing removably inserted in the hollow shaft of a metal arrow through a notch provided in the shaft wall, the transmitter housing having an antenna projecting from one end thereof and fitted with a barbed hook extending through the notch toward the arrowhead, for engaging the hide, bone or tissue of a game animal when the arrow strikes the animal and causing the transmitter to exit the arrow shaft through the notch and facilitate transmission of radio signals to a portable radio receiver held by the hunter, regardless of the location of the spent arrow.

A still further object of this invention is to provide an arrow and a bevelled radio transmitter which is designed to fit in a slot or notch provided in the shaft of the arrow, as well as a method of using the arrow-transmitter combination to track a game animal, which transmitter is equipped with an antenna and a curved, barbed hook which projects outwardly of the notch and faces toward the arrowhead, the hook adapted to engage the hide and/or bone or tissue of a game animal when the arrow strikes the animal, to retract the transmitter from the arrow through the notch, retain the transmitter in the animal and facilitate transmission of radio signals to a portable receiver held by the hunter and tuned to the frequency of the transmitter, regardless of the location of the spent arrow.

Another object of the invention is to provide a battery-operated transmitter for mounting in the hollow, notched shaft of a metal hunting arrow, which transmitter is characterized by a cylindrical housing having a curved, barbed hook shank extending from one end thereof and projecting through the notch in the arrow shaft, an antenna attached to a corresponding end of the housing and further including a wedge provided in the arrow shaft bore, wherein the arrow is adapted for receiving, carrying and finally removing the transmitter from the arrow shaft upon impact of the arrow with the animal.

A further object of the invention is to provide a method of tracking a game animal by radio which includes the steps of providing a notch or slot in the arrow shaft; inserting a battery-operated, hook-equipped radio transmitter in the notch or slot; impacting the arrow with the game animal to embed the hook in the game animal and remove the transmitter from the arrow shaft; and using a radio receiver tuned to the frequency of the transmitter, for tracking the game animal.

SUMMARY OF THE INVENTION

These and other objects of the invention are provided in a new and improved, battery-operated transmitter for use with a portable radio receiver, which transmitter is mounted in the shaft of a hollow metal arrow and includes a cylindrically-shaped transmitter housing designed to fit through a shaft notch communicating with the hollow interior of the arrow shaft, an antenna extending from one end of the transmitter housing through the notch and a hook having a barb and point also extending from the transmitter housing through the notch and pointed forwardly in the direction of travel of the arrow, for engaging a game animal, retracting the transmitter from the arrow housing through the notch and sending radio signals to the receiver held by the hunter and tracking the wounded animal, regardless of the position or location of the spent arrow.

BRIEF DESCRIPTION OF THE DRAWING

The invention will be better understood by reference to the accompanying drawing, wherein:

FIG. 1 is a top view of a metal hunting arrow having a hollow shaft, with a notch provided therein for receiving and exiting a transmitter;

FIG. 2 is a side view of the hunting arrow illustrated in FIG. 1, more particularly illustrating the transmitter access notch and an alternative wedge provided in the arrow shaft below the notch, in order to facilitate exit of the transmitter from the hollow arrow shaft when the arrow strikes a game animal;

FIG. 3 is a side elevation of the hunting arrow illustrated in FIGS. 1 and 2, with the transmitter positioned in the hollow shaft of the arrow;

FIG. 4 is a side elevation, partially in section, of the hunting arrow illustrated in FIG. 2, more particularly illustrating a preferred positioning of the transmitter in the hollow shaft of the hunting arrow forward of the notch and further illustrating a preferred location for the wedge to smoothly exit the transmitter from the shaft notch when the arrow strikes a game animal;

FIG. 5 is a side view of a preferred design for the arrow mounted transmitter, FIG. 6 is a rear perspective view of the wedge which is inserted in the hollow interior of the arrow shaft as illustrated in FIG. 4; and FIG. 7 is a perspective view of a deer having a hunting arrow protruding from its side, illustrating operation of the transmitter and a cooperating portable radio receiver.

DESCRIPTION OF THE PREFERRED EMBODIMENTS

Referring initially to FIGS. 1, 3 and 5 of the drawing, the arrow and removable transmitter of this invention is generally illustrated by reference numeral 1 and the transmitter 2 is configured in a preferred embodiment as illustrated in FIG. 5. The transmitter 2 includes a cylindrical transmitter housing *2a*, provided with suitable interior electronic components and a battery (not illustrated) which are designed to generate radio signals of a selected frequency, according to the knowledge of those skilled in the art. An antenna 3 projects from one end of the transmitter housing 2a, the projecting end of which antenna 3 is terminated at an antenna tip 4, for emitting the radio signals. An optional housing bevel 8 may be provided at the lower end of the transmitter housing 2a adjacent to the antenna 3, for purposes which will be hereinafter further described. A curved hook shank 5 extends from fixed attachment to or embedment in the rear end of the transmitter housing 2a, adjacent to the antenna 3. The hook shank 5 curves into a plane which is substantially parallel to the longitudinal plane of the transmitter housing 2a, to define a hook barb 6, and terminates in a forwardly-extending, sharp, hook tip 7. As illustrated in FIGURE 1, the carrier hunting arrow 9 includes a straight, hollow arrow shaft 10, which is typically constructed of aluminum tubing and is characterized by a shaft wall 11, defining an elongated shaft bore or cavity 12. Suitable feathers or fletching 13 is provided on the rear end of the arrow shaft 10, in order to stabilize the arrow 9 in flight and a string nock 14 is fitted to the rear end of the arrow shaft 10 behind the fletching 13 in conventional fashion, to receive a bowstring (not illustrated) for driving the arrow 9 from a bow (not illustrated). An arrowhead 15 is mounted on the opposite end of the arrow shaft 10 from the string nock 14. An antenna notch 16 is provided in the arrow shaft 10 rearwardly of the arrow head 15 in communication with the shaft cavity 12 of the arrow shaft 10 in order to receive the transmitter housing 2a and locate the transmitter 2 in the shaft cavity 12, as illustrated in FIG. 3. As illustrated in FIG. 5, a housing bevel 8 may be provided in the rear bottom portion of the transmitter housing 2a, below the antenna 3, and the antenna 3 and the housing bevel 8 cooperate to deflect the transmitter housing 2a from the shaft cavity 12 and through the antenna notch 16 when the arrow 9 is shot from a bow, as hereinafter described. Accordingly, it will be appreciated by those skilled in the art that when the arrow 9 is nocked into the bowstring of a bow and is shot from the bow, the arrow head 15 and arrow shaft 10 enter a game animal such as the deer 20, illustrated in FIG. 7 in conventional fashion. The hook tip 7 and hook barb 6 of the hook shank 5 then engage the hide, bone or tissue of the deer 20 and cause the transmitter 2 to exit the arrow shaft 10 through the antenna notch 16, as the arrow continues into the deer 20. Consequently, regardless of the final position of the spent arrow 9, that is, whether the arrow 9 travels completely through, or lodges in the deer 20 as illustrated in FIG. 7, or breaks or is pulled from the body of the animal as the animal runs, if the deer 20 is not killed immediately, the transmitter 2 will transmit a radio signal 18 of predetermined frequency to a tuned portable receiver 19, as illustrated in FIG. 7, and continually alert the hunter as to the position of the deer 20, for tracking purposes The receiver 19 is characterized by a battery-powered radio receiver having a directional antenna and an optional magnitude indicator and earphone (not illustrated) coupled thereto, in order to receive the radio signals 18 transmitted by the antenna 3 of the transmitter 2 and track the deer 20. It is understood that the frequency of the transmitter 2 is previously set to that of the receiver 19, in order to facilitate a continuous transmission of radio signals 18 from the transmitter 2 lodged in the deer 20, to the receiver 19.

Referring now to FIGS. 2, 4 and 6 of the drawing, in an alternative preferred embodiment of the invention the transmitter 2 is seated in the shaft cavity 12 of the arrow shaft 10, along with a previously-inserted, half-rounded and longitudinally tapered wedge 17, in order to facilitate smooth removal of the transmitter housing 2a from the antenna notch 16 when the hook tip 7 engages the hide, bone or tissue of the deer 20 as the arrow 9 penetrates the animal. The wedge 17 can be constructed of any suitable material, including wood, aluminum and the like, in non-exclusive particular, and is curved on the bottom thereof to match the curved configuration of the shaft wall 11, as illustrated in FIG. 6. The wedge 17 is most preferably located immediately beneath the antenna notch 16, with the inclined plane portion facing the transmitter housing 2a and the wedge 17 may be glued or otherwise secured in place inside the shaft cavity 12, as desired.

It will be appreciated by those skilled in the art that the arrow and removable transmitter apparatus of this invention is characterized by great efficiency in tracking deer and other game, since the transmission of radio signals does not depend upon the location of the spent arrow. However, if the arrow misses the intended target, it can easily be found, since the transmitter will not exit the arrow shaft unless the arrow strikes a game animal. Furthermore, referring again to the drawing, a sleeve or patch of metal tape 21, such as aluminum or stainless steel, in non-exclusive particular, can be applied to the arrow shaft 10 adjacent to and optionally over the antenna notch 16, in order to strengthen the arrow shaft 10 in the area of the antenna notch 16 and reduce the wind resistance against the antenna notch 16. However, since the antenna 3 and that portion of the hook shank 5 which projects from the antenna notch 16 are small, and therefore offer little wind resistance, very little adverse affect on the flight of the arrow 9 has been noted. Moreover, it is understood that arrows having solid arrow shafts constructed of such materials as plastic, fiberglass, wood and other suitable materials, may be provided with a notch 16, or a cavity and notch 16 combination, to accommodate the transmitter 2, as necessary.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. In a hunting arrow having a shaft provided with an arrowhead at one end and a nock at the opposite end for driving the arrow when hunting an animal, the improvement and combination therewith comprising a notch provided in said shaft; a radio transmitter adapted to fit in said radio notch, a bevel provided in one end of said radio transmitter and an antenna provided in said radio transmitter; and hook means carried by said radio transmitter, with said hook means extending from said one end of said radio transmitter above said bevel and a segment of said hook means projecting through said notch, whereby said segment of said hook means engages and lodges in the animal and removes said radio transmitter for said notch responsive to penetration of the animal by said arrow.

2. The hunting arrow of claim 1 wherein said antenna extends from said one end of said radio transmitter at said bevel. said one end of said radio transmitter at said bevel.

3. The hunting arrow of claim 2 wherein said hook means further comprises a curved hook shank having one end attached to said radio transmitter with the opposite end of said hook shank curved toward the arrowhead of the arrow, said opposite end of said hook shank terminating in a sharp point for penetrating the game animal.

4. The hunting arrow of claim 3 further comprising a barb provided in said opposite end of said hook shank for securing said sharp point of said hook shank in the game animal independently of said arrow.

5. The hunting arrow of claim 7 further comprising a wedge inserted in said notch for directing said radio transmitter through said notch and from said arrow when said opposite end of said hook shank engages the game animal.

6. In a hunting arrow having a shaft provided with an arrowhead at one end and a nock at the opposite end for driving the arrow when hunting an animal, the improvement in combination therewith comprising a cavity provided in said shaft; a notch provided in said shaft in communication with said cavity; a battery-powered radio transmitter characterized by a transmitter housing adapted to fit through said notch and into said cavity; a bevel provided in one end of said radio transmitter housing; an antenna carried by said transmitter housing; and hook means carried by said one end of said transmitter housing, with a segment of said hook means projecting from said cavity through said notch, whereby said segment of said hook means engages and lodges in the animal and remove said battery-powered radio transmitter from said cavity and said notch responsive to penetration of the animal by said arrow.

7. The hunting arrow of claim 6 wherein said hook means further comprises a curved hook shank having one end carried by said transmitter housing, with the opposite end of said hook shank curved toward the arrowhead of the arrow, said opposite end of said hook shank terminating in a sharp point for penetrating the game animal.

8. The hunting arrow of claim 7 further comprising a barb provided in said opposite end of said hook shank for securing said opposite end of said hook shank in the game animal independently of said arrow.

9. The hunting arrow of claim 6 further comprising a wedge inserted in said cavity substantially beneath said notch for directing said radio transmitter from said cavity through said notch and from said arrow when said segment of said hook means engages the game animal.

10. The hunting arrow of claim 9 wherein said hook means further comprises a curved hook shank having onle end attached to said transmitter housing, with the opposite end of said hook $hank curved toward the arrowhead of the arrow, said opposite end of said hook shank terminating in a sharp point, and a barb provided in said opposite end of said hook shank, for retaining said opposite end of said hook shank in the game animal independently of said arrow.

11. In a hunting arrow having a hollow shaft provided with an arrowhead at one end and a nock at the opposite end for driving the arrow when hunting a game animal, the improvement in combination therewith comprising a notch provided in said hollow shaft., a battery-powered radio transmitter characterized by a bevelled transmitter housing adapted to fit through said notch into said hollow shaft; an antenna carried by said transmitter housing, said antenna normally extending through said notch when said transmitter housing is located in said hollow shaft; and hook means carried by said transmitter housing, with a segment of said hook means projecting from said hollow shaft through said notch, whereby said segment of said hook means engages the game animal and removes said battery-powered radio transmitter from said hollow shaft through said notch responsive to penetration of the game animal by said arrow.

12. The hunting arrow of claim 11 wherein said hook means further comprises a curved hook shank having one end attached to said transmitter housing, with the opposite end of said hook shank curved toward the arrowhead of the arrow, said hook shank terminating in a sharp point, and a barb provided in said opposite end of said hook shank, for retaining said opposite end of said hook shank in the game animal independently of said arrow.

13. The hunting arrow of claim 12 further comprising a wedge inserted in said hollow shaft substantially beneath said notch for directing said radio transmitter from said hollow shaft through said notch and from said arrow when said opposite end of said hook shank engages the game animal.

* * * * *